US005187901A

United States Patent [19]

Karlsrud

[11] Patent Number: 5,187,901

[45] Date of Patent: Feb. 23, 1993

[54] CIRCUMFERENTIAL PATTERN FINISHING MACHINE

[75] Inventor: Chris E. Karlsrud, Chandler, Ariz.

[73] Assignee: Speedfam Corporation, Des Plaines, Ill.

[21] Appl. No.: 473,894

[22] Filed: Feb. 2, 1990

[51] Int. Cl.[5] ..... B24B 5/02

[52] U.S. Cl. ..... 51/132; 51/131.3

[58] Field of Search ..... 51/128, 129, 131.1, 51/131.2, 131.3, 132, 133, 134

[56] References Cited

U.S. PATENT DOCUMENTS

| | | | |
|---|---|---|---|
| 2,992,519 | 7/1961 | Pearson | 51/129 |
| 3,050,910 | 8/1962 | Lichtenfeld | 51/129 |
| 3,111,791 | 11/1963 | Harris et al. | 51/129 |
| 3,304,662 | 2/1967 | Boettcher . | |
| 3,374,582 | 3/1968 | Boettcher . | |
| 3,518,798 | 7/1970 | Boettcher . | |
| 3,570,188 | 3/1971 | Ebner | 51/129 |
| 4,502,252 | 3/1985 | Iwabuchi | 51/132 |
| 4,593,496 | 6/1986 | Klievoneit et al. | 51/132 |
| 4,667,445 | 5/1987 | Kimura | 51/131.1 |

OTHER PUBLICATIONS

"General Products Information", Speedfam Corp., (Jul., 1989), pp. 4–6.

*Primary Examiner*—Bruce M. Kisliuk
*Assistant Examiner*—John A. Marlott
*Attorney, Agent, or Firm*—Allegretti & Witcoff, Ltd.

[57] ABSTRACT

A disc finishing machine comprising an annular upper platen, lower platen, a center driving ring, a plurality of a clamping guide rollers, a plurality of stationary guide rollers, a clamping guide roller, and stationary guide roller perpendicularly attached to one of a plurality of a roller stanchions. The polishing machine capable of imparting a circumferential pattern on a plurality of disc-shaped work pieces.

12 Claims, 3 Drawing Sheets

CIRCUMFERENTIAL PATTERN FINISHING MACHINE

BACKGROUND OF INVENTION

This invention is related to a machine capable of grinding and polishing a plurality of disc-shaped work pieces simultaneously, and a method for using the machine to impart a circumferential pattern on the plurality of disc-shaped work pieces.

Computer memory discs are typically highly polished articles which must meet rigorous quality specifications. Any flaw on the surface of a hard disc will result in the permanent loss of at least a portion of the memory capacity of that disc. The grinding and polishing of such hard discs by machines of the prior art have resulted in hard discs having radial, or rose petal patterns in which there are small grooves running from the center of the disc to the outside radius of the disc, or in discs with spiral patterns where the spiral begins in the center of the disc and spirals until it ends at the outside of the hard disc. Flaws in the radial or spiral impressions may cut across large lateral portions of the disc resulting in the loss of a very substantial amount of potential memory space, making the disc unusable.

Newer machines may impart a circumferential pattern on the hard disc. The desired circumferential pattern consists of a series of concentric rings beginning in the center of the hard disc and radiating towards the outside edge of the hard disc. A flaw in a concentric ring of the circumferential pattern will result in the loss of only a small portion of the hard disc memory capacity, namely the memory capacity defined by the flawed concentric circle. Present methods of imparting a circumferential pattern on a hard disc are time consuming because they are slow, and because only one disc at a time can be machined.

SUMMARY OF THE INVENTION

It is an object of this invention to provide a machine for grinding and polishing a plurality of disc-shaped work pieces, the machine having at least one motor capable of driving an upper annular platen, a lower annular platen, and a center driving ring. It is a further object of this invention to provide a machine for grinding and polishing a plurality of disc-shaped work pieces wherein the machine comprises stationary guide rollers, clamping guide rollers, a stationary guide roller and a clamping guide roller perpendicularly attached to one of a plurality of roller stanchions.

Accordingly, a broad embodiment of this invention is a machine for finishing a plurality of disc-shaped work pieces. Finishing comprises both grinding and polishing and may comprise any other necessary or desirable methods of machining disc-shaped work pieces. The machine comprises a framework, a polishing assembly, the polishing assembly including an annular lower platen perpendicularly connected to a first spindle, an annular upper platen perpendicularly connected to a second spindle, a center driving ring perpendicularly connected to a third spindle, and at least one motor able to rotate the first, second and third spindles. The machine also comprises a plurality of stationary guide rollers, a plurality of clamping rollers, and a plurality of roller stanchions. A stationary guide roller and a clamping guide roller are perpendicularly attached to each roller stanchion. Each disc-shaped work piece is held essentially perpendicular to the first, second and third spindles and in-between the upper and lower annular platens by frictional contact with the center driving ring and with a stationary guide roller and a clamping roller.

In another embodiment, this invention is a machine for finishing a plurality of metal disc-shaped work pieces comprising a framework, a polishing assembly and two motors. The polishing assembly includes a annular lower platen perpendicularly connected to a first spindle, an annular upper platen perpendicularly connected to a second spindle with both the upper and lower platens centered essentially over the disc axis of each of the plurality of disc-shaped work pieces, the disc axes of the disc-shaped work pieces defining a first concentric circle, and a center driving ring perpendicularly connected to a third spindle, the outer edge of the center driving ring defining a second concentric circle. The machine also comprises a plurality of stationary guide rollers, a plurality of clamping rollers, and a plurality of roller stanchions. A stationary guide roller and a clamping guide roller are both perpendicularly connected to each roller stanchion. The stationary guide roller is capable of rotating about a first axis while the clamping guide roller is capable of rotating about a second axis. The roller stanchion is capable of pivoting on the first axis. Each roller stanchion is located such that the clamping guide roller and the stationary guide roller perpendicularly attached to the roller stanchion contact adjacent disc-shaped work pieces, the stationary guide rollers and clamping guide rollers combining to define a third concentric circle with the first concentric circle having a greater diameter than the second concentric circle, and the third concentric circle having a greater diameter than the first concentric circle. Each disc-shaped work piece is secured into a disc position between the upper and lower platens by frictional contact with the center driving ring, with a stationary guide roller and with a clamping guide roller. In this embodiment, the first and second spindles are rotated by a first motor, while the third spindle is rotated by a second motor.

It is also an object of this invention to provide a method for finishing a plurality of disc-shaped work pieces. The method imparts a circumferential pattern on the top and bottom dimensions of the plurality of disc-shaped work pieces simultaneously.

The method utilizes a machine having a framework, a polishing assembly, and at least one motor. The polishing assembly includes an annular lower platen perpendicularly connected to the first spindle, an annular upper platen perpendicularly connected to a second spindle, and a center driving ring perpendicularly connected to a third spindle, with at least one motor rotating the first, second and third spindles about a spindle axis. The machine used in the method also comprises a plurality of stationary guide rollers, a plurality of clamping rollers, and a plurality of roller stanchions, with a stationary guide roller and a clamping guide roller perpendicularly attached to each roller stanchion. The method comprises the steps of placing a disc-shaped work piece in a disc position between the upper and lower annular platens and into frictional contact with the center driving ring, a stationary guide roller, and a clamping guide roller. This step of placing a disc-shaped work piece in a disc position is repeated until the plurality of disc positions into which a disc-shaped work piece can be placed each contain a disc-shaped work piece. The disc-shaped work pieces are then ground by rotating the center driving ring at a low RPM to thereby rotate the disc-shaped work pieces while simultaneously rotating the upper and lower platens while in contact with the plurality of disc shaped work pieces at an RPM greater than that of the center driving ring for a period time sufficient to remove the desired amount of stock from the plurality of disc-shaped work pieces. The plurality of disc-shaped work pieces are polished to impart a circumferential pattern on the top and bottom dimension of each by increasing the RPM of the center driving ring and reducing the RPM of the upper and lower annular platens while still contacting the disc-shaped work pieces with the grind stone or polishing pad for a period of time sufficient to impart a circumferential pattern on the disc-shaped work piece.

In another embodiment, this invention is a method for grinding and polishing a plurality of disc-shaped work pieces to impart a circumferential pattern thereon. The method utilizes a machine having a framework, a polishing assembly, and two motors. The polishing assembly includes an annular lower platen perpendicularly connected to a first spindle, and an annular upper platen perpendicularly connected to a second spindle. The first and second spindles are rotated around a spindle axis by a first motor with both the upper and lower platens being centered essentially over the disc axis of each of the plurality of disc-shaped work pieces. The disc-shaped work pieces are located in a circular pattern such that the disc axes of the disc-shaped work pieces combine to define a first concentric circle.

The machine has a center driving ring perpendicularly connected to a third spindle. The third spindle is rotated around a spindle axis by a second motor. The outer edge of the center driving ring defines a second concentric circle. The machine comprises a plurality of stationary guide rollers, a plurality of clamping guide rollers and a plurality of roller stanchions. A stationary guide roller and a clamping guide roller are both perpendicularly connected to each roller stanchion. The stationary guide roller is capable of rotating about a first axis while the clamping guide roller is capable of rotating about a second axis. The roller stanchion is capable of pivoting about the first axis. Each roller stanchion is located such that the clamping guide roller and the stationary guide roller perpendicularly attached to the roller stanchion contact adjacent disc-shaped work pieces. The combination of the stationary guide rollers and clamping guide rollers define a third concentric circle. The first concentric circle has a greater diameter than the second concentric circle and the third concentric circle has a greater diameter than the first concentric circle. The combination of the center driving ring, a stationary guide roller and an adjacent clamping guide roller fictionally hold a disc-shaped work piece in a disc position between the upper and lower annular platens. The disc-shaped work pieces are finished by the steps of pivoting the plurality of roller stanchions on a first axis away from the center driving ring to define a plurality of disc positions able to provide for the frictional contact of the disc-shaped work piece with a center driving ring and a stationary guide roller. Each disc-shaped work piece is loaded between the upper and lower annular platens and into one of the plurality of disc position. The steps above are repeated until the plurality of disc positions are occupied by a disc-shaped work piece. The roller stanchions are then pivoted on the first axis to move the clamping guide rollers into contact with the disc-shaped work pieces. The plurality of disc-shaped work pieces are ground by applying a pressure on the top and bottom dimension of the disc-shaped work piece with the upper and lower annular platens. The upper and lower annular platens are rotated around the stanchion axis in the same direction and at the same number of RPM with the upper and lower platen rotating at from around 50 to 90 RPM while simultaneously rotating the center driving ring around the stanchion axis at from about 20 to about 40 RPM to thereby rotate the plurality of disc-shaped work pieces about their disc axes. The upper and lower annular platens and the center driving ring are rotated for a period of time ranging from about thirty seconds to about three minutes. A circumferential pattern is imparted on the plurality of metal discs by increasing the rotation of the center driving ring to from about 135 to about 180 RPM to thereby increase the rotation of the plurality of disc-shaped work pieces to from about 800 to about 1200 RPM and by reducing the rotation of the upper and lower annular platens to from about 5 to about 20 RPM for a period of time ranging from thirty seconds to about one minute. Finally, the plurality of disc-shaped work pieces, the top and bottom dimension on which has a circumferential pattern has been imparted are unloaded from the plurality of disc positions they occupy.

BRIEF DESCRIPTION OF THE DRAWINGS

There is shown in the attached drawings a presently preferred embodiment of the present invention, wherein like numerous in a various reviews referred to like elements and wherein.

DESCRIPTION OF THE PREFERRED EMBODIMENTS

The present invention is a finishing machine and a method for utilizing the finishing machine to impart a circumferential pattern on both the top and bottom dimensions of a plurality of disc-shaped work pieces simultaneously.

Figure 1:
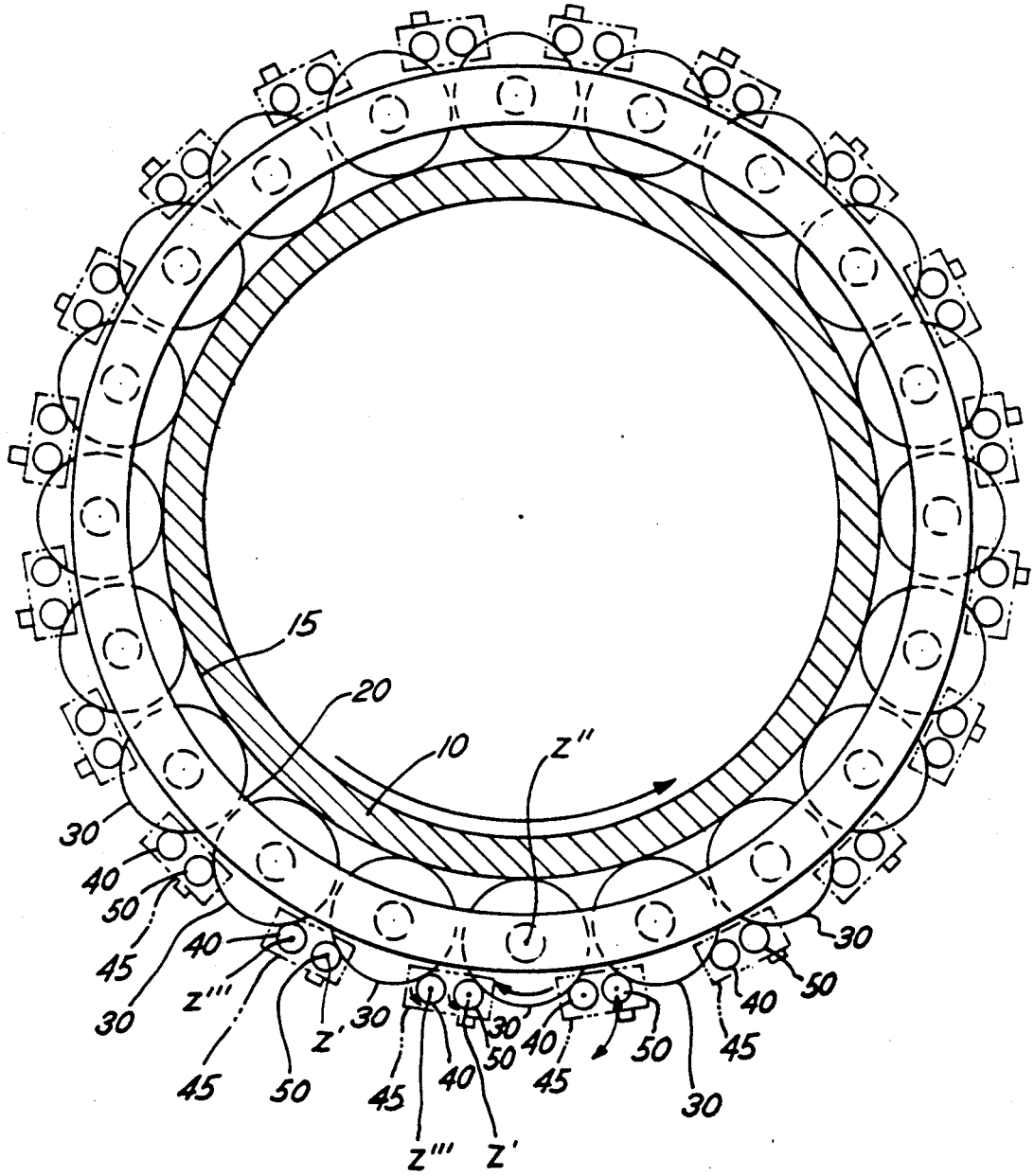
FIG. 1 shows an overhead view of the various aspects of the finishing machine of this invention.

The invention is first explained with reference to the Figures in which like elements are identified by the same number. FIG. 1 shows an overhead view of the layout of the finishing machine of this invention. The machine comprises a center driving ring 10, having an outer edge 15, an upper annular platen 20, stationary guide rollers 40, clamping guide rollers 50, roller stanchions 45, and disc-shaped work pieces 30. The disc-shaped work pieces 30 are placed in positions such that the disc axis Z″ of the disc-shaped work piece 30 combine to form a first concentric circle. The annular upper platen 20 is essentially centered over the disc axis Z″ of each disc-shaped work piece 30. The center driving ring 10 forms a second concentric circle that is smaller in diameter than the first concentric circle. Each roller stanchion 45 is perpendicularly attached to a stationary guide roller 40 and a clamping guide roller 50. The stationary guide roller 40 is capable of rotating around a first axis Z'''. The clamping guide roller 50 is capable of rotating around a second axis Z'. The roller stanchion 45 is also capable of pivoting towards and away from the disc-shaped work piece 30 on axis Z'''. The stationary guide roller 40 and clamping guide roller 50 are located in a circular pattern around the finishing machine in such a manner to define a third concentric circle. The third concentric circle is larger in diameter than the second concentric circle defined by the combination of disc axes Z''.

When the machine is in operation, the center driving ring 10, for example, will rotate in a counter-clockwise direction. The disc-shaped work pieces 30 are in frictional contact with the center driving ring 10 and with a stationary guide roller 40 and a clamping guide roller 50. The rotation of the center driving ring 10 in a counter clock-wise direction will cause the disc-shaped work pieces 30 to all rotate around disc axis Z'' in a direction opposite that of the center driving ring 10. The rotation of the disc-shaped work pieces 30 will in turn cause the stationary guide rollers 40 and the clamping guide rollers 50 to rotate in a direction identical to that of the center driving ring. The stationary guide rollers 40 rotate around a first axis Z''' while the clamping guide rollers 50 rotate around a second axis Z'.

Figure 2:
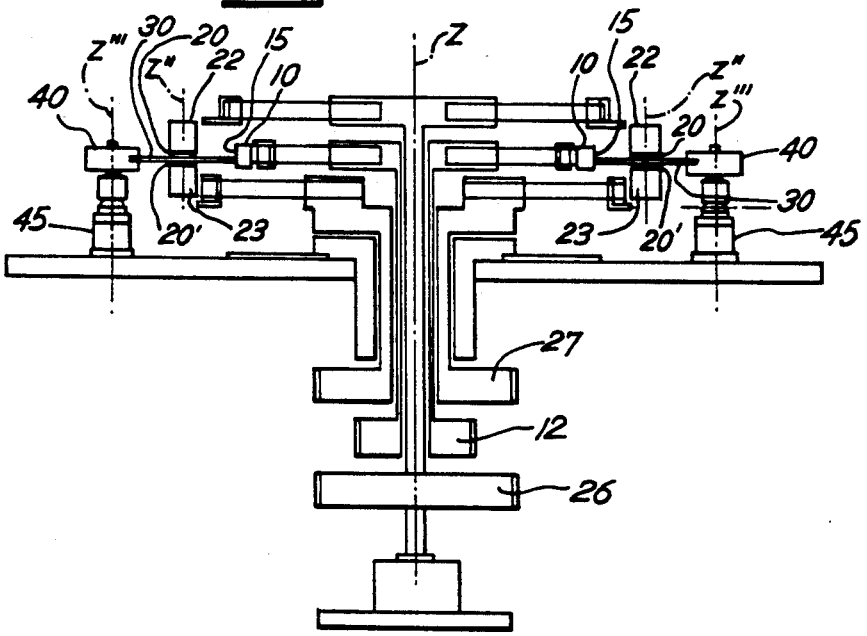
FIG. 2 shows a side view of various aspects of the finishing machine of this invention.

FIG. 2 shows a side view of various aspects of the grinding and polishing machine of this invention. The machine comprises an annular lower platen 23 which is perpendicularly attached to a first spindle 27. The lower annular platen is centered essentially over the disc axis Z'' of the disc-shaped work pieces 30. The machine also comprises an upper annular platen 22. The upper annular platen 22 is perpendicularly attached to a second spindle 26.

The upper annular platen 22 and lower annular platen 23 both contain a grind stone or polishing pad 20 or 20' which directly contacts the disc-shaped work pieces 30. A center driving ring 10 is perpendicularly attached to a third spindle 12. The outer edge 15 of the center driving ring 10 is in frictional contact with the edge of the disc-shaped work piece 30. The disc-shaped work piece 30 is also in frictional contact with a stationary guide roller 40, and a clamping guide roller 50 (not shown) which are both perpendicularly connected to a single roller stanchion 45.

The first spindle 27, the second spindle 26, and a third spindle 12 all rotate around the spindle axis Z. Each of the spindles can be independently rotated at various speeds by separate motors connected by pulleys and belts to the spindles, or by a single motor or by two motors. The third spindle 12 causes the center driving ring 10 to rotate. This rotation of the center driving ring 10 causes the disc-shaped work piece 30 to rotate around disc axis Z''. The rotation of the disc-shaped work piece 30 further causes the stationary guide roller 40 to rotate in place around the first axis Z'''. The first spindle 27, and the second spindle 26 rotate and cause the upper annular platen 22 and lower annular platen 23 to rotate either in the same direction or in opposite directions at the same or different speeds. The grind stone or polishing pad 20 and 20' of the upper and lower annular platens 22 and 23 are brought in to contact with the disc-shaped work piece 30 in order to finish the disc-shaped work pieces 30.

Figure 3A:
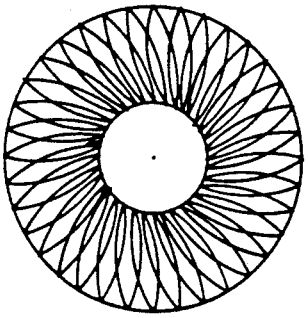
FIGS. 3*a, b,* and *c* depict various patterns imparted on a disc-shaped work piece by the finishing machine of this invention and by grinding machines of the prior art.
Figure 3B:
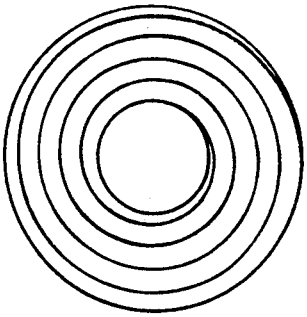
Figure 3C:
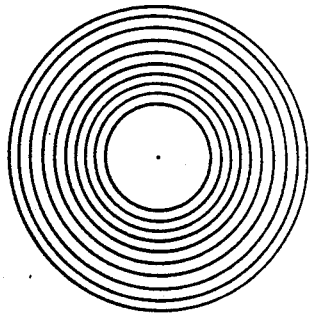

FIGS. 3*a, b* and *c* depict various patterns imparted on a disc-shaped work piece by the finishing machine of this invention and by grinding and polishing machines of the prior art. Disc Pattern 3*a* is a radial or petal pattern which is produced by prior art grinding and polishing machines. The drawback with this pattern is that a flaw in one of the petal dimensions will run from the inside disc diameter to the outside disc diameter and may result in such a substantial loss memory space on the disc that the disc must be scrapped. Disc Pattern 3*b* is a more preferred spiral pattern produced by machines of the prior art. A flaw in the spiral will result in a smaller portion of the memory capabilities of the disc being lost. Finally, disc Pattern 3*c* is a desired circumferential pattern produced by the finishing machine of this invention. The desired circumferential disc Pattern 3*c* comprises a plurality of concentric circles radiating from the center of the disc to the outer diameter of the disc. A flaw in a single concentric pattern will only result in the loss of the memory contained in that concentric pattern. This is because the concentric pattern mimics the method that is used by a computer to read the memory disc. The computer will read the memory disc essentially in a pattern of concentric circles. Therefore, a flaw in a single concentric circle will not result in a flaw in all of the concentric circles when the disc is imparted with a circumferential pattern.

Figure 4A:
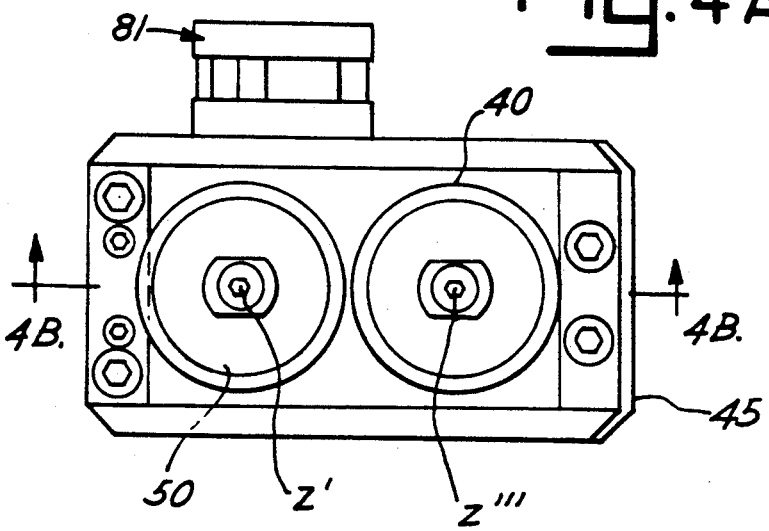
FIGS. 4*a* and *b* depict a detailed cross-section view, and overhead view of various aspects of the roller stanchion of this invention.
Figure 4B:
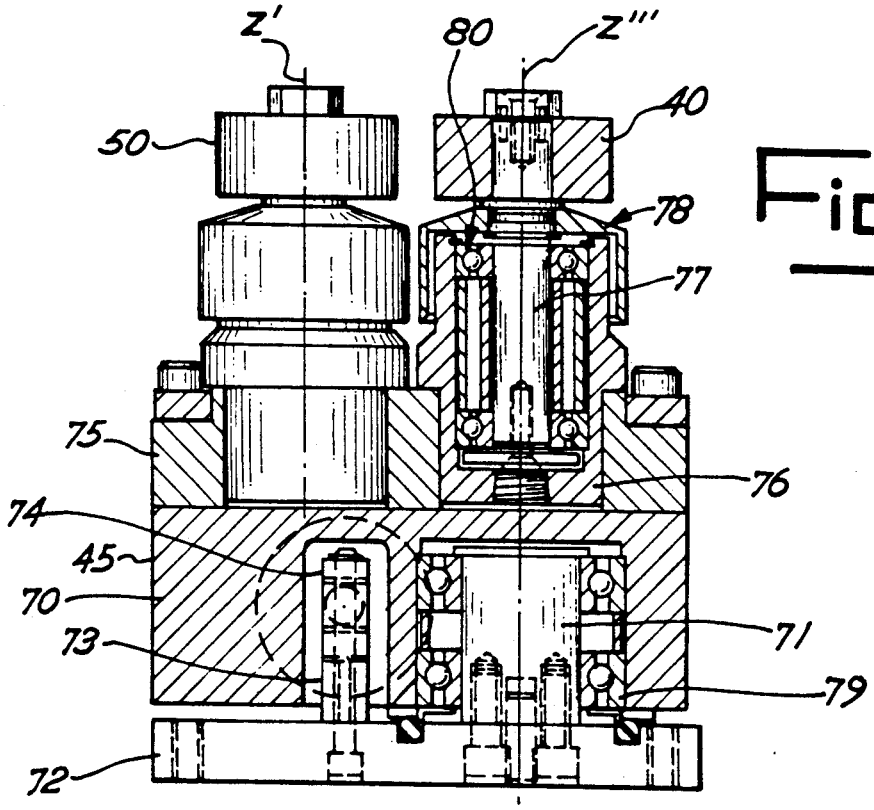

FIGS. 4*a* and *b* depict detailed overhead and cross-section views of various aspects of the roller stanchion of this invention. The roller stanchion 45 of this invention comprises a main housing 70 to which a stationary guide roller 40 and a clamping guide roller 50 are perpendicularly attached. The stationary guide roller 40 rotates around a first axis Z''' while the clamping guide roller 50 rotates around a second axis Z'. The roller stanchion 45 comprises a pivot shaft 71. The pivot shaft 71 corresponds to the first axis Z'''. The roller stanchion 45 including the clamping guide roller 50 and stationary guide roller 40 pivots on the first axis Z''' towards and away from the disc-shaped work piecews on pivot shaft 71. When the roller stanchion 45 pivots, the clamping guide roller 50 moves laterally towards or away from the disc-shaped work pieces 30 (not shown) while the stationary guide roller 40 remains essentially stationary.

The roller stanchion 45 comprises a base plate 72 attached to the main housing 70 by a pin base and pin 73. The roller stanchion 45 also comprises a pin clevis 74, a stanchion base 75 which provides a location to which the stationary guide roller 40 and the clamping guide roller 50 are attached via stanchion housing 76. The stationary guide roller 40 and the clamping guide roller 50 rotate around a first axis Z''' and second axis Z' respectively by means of stanchion shaft 77. A splash cover 78 protects the stanchion shaft 77 and stanchion bearings 80 from contamination. Pivot bearings 79 allow the roller stanchion 45 to pivot on the first axis Z'''. A pneumatic cylinder 81 is actuated to pivot the roller stanchion 45 towards or away from the disc-shaped work pieces 30 on the pivot bearing 79.

The machine of this invention is useful for finishing disc-shaped work pieces. These discs may be made of metal, hard plastics, ceramics, glass or any other grindable material. It is preferred that the discs are manufactured of metal and are relatively thin with each having a top and bottom dimension. In one application, the discs are utilized for computer memory discs. The preferred metal discs may be manufactured out of any type of metal useful for computer memory discs or other applications. It is believed that specific alloys such as aluminum might be preferred. The important variables sought to be imparted in a circumferential pattern disc-shaped work piece are a high quality surface finish and a good roll-off. "Roll-off" is a measure of the sharpness of the edge of the metal disc and is important because roll-off is directly related to a computer's ability to read and store information on a hard disc.

The finishing machine and method of this invention will be most useful in performing the final grinding and polishing steps on a plurality of disc-shaped work pieces. It is anticipated that a preferred metal disc-shaped work piece will first undergo rough grinding steps before the final grinding and polishing steps are performed using the machine of this invention. The machine of this invention is capable of imparting the radial, spiral, or preferred circumferential pattern on the top and bottom dimension of a plurality of disc-shaped work pieces simultaneously. However, the circumferential pattern is the preferred disc pattern for computer hard discs. It is anticipated that disc patterns useful in alternative applications including spiral and radial patterns could easily be imparted on a plurality of disc-shaped work piece by the machine of this invention.

The machine of this invention comprises various parts, which acting together, are capable of imparting a specific disc pattern simultaneously on the top and bottom dimension of the plurality disc-shaped work pieces. The machine comprises a center driving ring. The purpose of the center driving ring is to fictionally contact all of the plurality of disc-shaped work piece and to impart a spinning motion on said disc-shaped work piece. The center driving ring is a circular ring which is perpendicularly attached to a third spindle. The third spindle is attached to a motor by a means for transferring the motor rotation to the spindle to thereby rotate the spindle around a spindle axis. The third spindle rotation causes the center driving ring to rotate. The center driving ring contacts the plurality of disc-shaped work pieces and causes each disc-shaped work piece to rotate around a disc axis in a direction opposite the rotation of the center driving ring. Therefore, a center driving ring rotating in a counter-clockwise direction will impart a clockwise rotation on the plurality of disc-shaped work pieces and vice-versa. It is anticipated that the center driving ring will have a slightly softer material on its outer edge where it contacts the plurality of disc-shaped work pieces. Finally, as mentioned above, the center driving ring is circular in shape, with the outer edge of the center driving ring defining a second concentric circle. The second concentric circle dimension will be compared to other dimensions below to make the orientation of the various elements of the machine apparent.

The machine also comprises an upper annular platen and a lower annular platen. The purpose of the annular platens are to contact the top and bottom dimensions of the plurality of disc-shaped work pieces and through rotation of the upper and lower annular platens coupled with the disc rotation, grind, polish and finish both the top and bottom dimensions of the plurality of disc-shaped work pieces. The lower annular platen is perpendicularly connected to a first spindle while the upper annular platen is perpendicularly connected to a second spindle. The first and second spindle are either connected to separate motors or to the same motor by a means capable of transferring the motor's rotation to the first and/or second spindles. The upper and lower annular platens rotate essentially around the spindle axis, the same axis around which the center driving ring rotates. The upper and lower annular platens can rotate in the same directions at the same speed, or they may rotate in opposite directions at the same speed or they may rotate at non-identical speeds in the same or opposite directions.

The upper and lower annular platens are located such that the center portion of the upper and lower annular platens containing the grind stone or polishing pad passes across the center or disc axis of each of the disc-shaped work pieces. It is possible to vary the location of the upper and lower annular platens with respect to the disc axes of the disc-shaped work pieces. However, best finishing results are obtained when the upper and lower annular platens are located essentially over the center of the disc-shaped work pieces.

The upper and lower annular platens are brought into contact with the disc-shaped work pieces and the rotation of the upper and lower annular platens allows the grind stone of the polishing pad to abrade, polish, and finish the disc-shaped work pieces. The annular upper and lower platens may be brought into contact with the disc-shaped work piece by applying a platen force via downward pressure from the annular upper platen, by applying upward pressure from the lower annular platen, by both means, or by any other means apparent in the art for applying an even plate force to the disc-shaped work pieces sufficient to grind, polish, or finish the plurality of disc-shaped work pieces. The platen force will typically range from 0 to 190 lbs.

The upper and lower annular platens may contain ports for supplying either polishing slurry or grinding coolant to the disc-shaped work pieces, or polishing slurry and/or grinding coolant may be supplied from some source besides the platens to the disc-shaped pieces by any means known in the art. The polishing slurry may be any polishing slurry known in the art to be compatible with the particular material of construction of the plurality of disc-shaped work pieces. One preferred type of polishing slurry is aluminum oxide slurry. Alternatively, or in conjunction with the application of polishing slurry to the plurality of disc-shaped work pieces, grinding coolant may also be applied to the plurality disc-shaped work pieces. The purpose of the grinding coolant is to keep the plurality of disc-shaped work pieces at a relatively constant temperature during grinding, polishing, and finishing steps. The grinding coolant is preferably a soapy solution, that is a solution containing some type of surfactant. A preferred type of grinding coolant is Crystal Cut 1001 or 1002 manufactured by Kanebo.

The surface of the upper and lower annular platens which contact the disc-shaped work pieces may comprise an abrasive material such as a grind stone material or the upper and lower annular platens may contain polishing pads, or a mixture of the two can be used. It is preferred that the upper and lower annular platens consist of a metal base covered by a grinding stone or a polishing pad. However, any currently existing grinding and polishing methods that are known in the art may be utilized in conjunction with the upper and lower annular platens to grind, polish, and finish the plurality of disc-shaped work pieces.

The machine of this invention comprises at least one motor. Generally, one, two or three motors are used to rotate the first, second and third spindles about the spindle axis. The first, second and third spindles are attached respectively to the lower annular platen, the upper annular platen, and the center driving ring. The motor or motors may be connected by a means known by one of ordinary skill in the art such as a belt and pulley system to each of the spindles. When three motors are used, the first motor is attached to the first spindle, the second motor is attached to the second spindle, and the third motor is attached to the third spindle. Alternatively, when the machine consists of two motors, it is preferred that the first motor is used to drive the first and second spindles while the second motor is used to drive the third spindle. When one motor is used, it rotates all the spindles. By connecting a single motor to a transmission, the three spindles can be operated at different speeds. As mentioned above, the first, second and third spindles rotate about the spindle axis.

The machine further comprises clamping guide rollers and stationary guide rollers. The purpose of the clamping guide rollers and stationary guide rollers are to act in conjunction with the center driving ring to fictionally hold each disc-shaped work piece in a disc position between the upper and lower annular platens so that the disc-shaped work pieces may be rotated without lateral movement.

The machine comprises a plurality of stationary guide rollers. Each stationary guide roller is perpendicularly connected to a roller stanchion. Each stationary guide roller may rotate, and in fact, does rotate about a first axis when in contact with a rotating disc-shaped work piece. The rotation of each disc-shaped work piece causes both a clamping guide roller and a stationary guide roller to rotate in a direction opposite to that of the disc-shaped work pieces. Other than their ability to rotate, the stationary guide rollers are essentially immobile.

The machine comprises a plurality of roller stanchions. Each roller stanchions is located between adjacent disc-shaped work pieces such that a stationary guide roller and a clamping guide roller perpendicularly attached to the roller stanchion contact adjacent disc-shaped work pieces. The purpose of the roller stanchions is to provide a stable base to which the clamping guide rollers and stationary guide rollers are attached, and also to provide a means for pivoting the clamping guide rollers towards and away from the disc-shaped work pieces. The stationary guide roller rotates around a first axis. This first axis is the same axis on which the entire roller stanchion pivots towards and away from the disc-shaped work pieces. During the pivoting process the stationary guide roller remains stationary slightly rotating on the first axis while the clamping guide roller moves away from or towards the disc-shaped work piece or the disc position to allow for the insertion or removal of a disc-shaped work piece from the disc position. When a disc is inserted into the disc position, the roller stanchion is pivoted on the first axis to bring the clamping guide roller into contact with the disc-shaped work piece.

The roller stanchion may be actuated to pivot the clamping guide roller towards or away from the disc-shaped work piece by any means known in the art. It is preferred that a pneumatic actuator be used to pneumatically pivot the roller stanchion. When a pneumatic actuator is used to pivot the roller stanchion on a first axis, the clamping guide roller is imparted with some give depending on the clamping force used to pneumatically contact a clamping roller with a disc-shaped work piece. This "give" allows the clamping guide roller and the roller stanchion to slightly move on the first axis to account for slight variations in the circumference of the disc-shaped work piece which is contacted by the particular clamping guide roller. Generally, the clamping force will vary from 0 to 20 lbs.

In order to load a disc-shaped work piece into a disc position between the upper and lower annular platens, the clamping guide roller is moved laterally away from the center driving ring by pivoting the roller stanchion on the first axis. The disc-shaped work piece is contacted with the center driving ring and with a stationary guide roller in a disc position. Finally, the clamping guide roller is laterally moved in towards the center driving ring until it contacts the disc-shaped work piece again by pivoting the roller stanchion on the first axis. At this point a disc-shaped work piece is fictionally held into one of a plurality of disc positions by the center driving ring, by a clamping guide roller and by a stationary guide roller all in-between the upper and lower annular platens.

If a line is drawn through the first and second axis of the plurality of stationary guide rollers and clamping guide rollers, the results will be the third concentric circle. Additionally, the clamping guide rollers are alternated with stationary guide rollers in their placement about this third concentric circle. Therefore, the result is an alternating concentric circle of stationary guide rollers and clamping guide rollers.

A plurality of disc-shaped work pieces are located in the plurality of disc positions such that each disc-shaped work piece is in frictional contact with the center driving ring with a stationary guide roller and with a clamping guide roller. The center driving ring contacts each disc-shaped work piece at one point on its outer edge. A line drawn through the disc axis of the plurality of disc-shaped work pieces will form a first concentric circle. The first concentric cirlce is greater in diameter than the second concentric circle. The first concentric circle, however, is smaller in diameter than the third concentric circle.

The description above includes important aspects of the finishing machine of this invention. Other aspects of the machine including the machine's housing, safety equipment, exact arrangement within the housing, electronic connections, power connections, etc. have been omitted. These aspects of the machine should be apparent to one of ordinary skill in the art and are therefore not discussed.

The finishing machine of this invention has been engineered to produce the highly desired circumferential pattern upon disc-shaped work pieces as opposed to the radial or "rose petal" pattern currently achieved with standard machines. A good analogy of a circumferential pattern would be a phonograph record on which it appears to have a vast number of concentric circles on its surface. The machine of this invention can now impart a similar pattern on a plurality of disc-shaped work pieces by simultaneously grinding and polishing the plurality of disc-shaped work pieces.

The method of producing a circumferential pattern on a plurality of disc-shaped work piece is accomplished by first rotating the plurality of disc-shaped work piece by rotating the center driving ring at a high RPM. The rotating disc-shaped work pieces are stabilized by frictional contact with the combination of a stationary guide roller and a clamping guide roller and the center driving ring. Finishing is then achieved by rotating the upper and lower annular platens at various speeds while contacting the top and bottom dimensions of the disc-shaped work pieces with the grind stone or polishing pad with the appropriate amount of pressure. A high quality circumferential pattern is obtained on the top and bottom dimensions of each disc-shaped work piece when a very slow upper and lower annular platen RPM is combined with a high disc RPM. Optimum flatness, roll-off, surface finish and material removal can be achieved by combining various platen/-disc speed combinations. Other key machine parameters are platen pressure, coolant/slurry flow rates, and clamping force which is applied by the clamping guide roller in conjunction with the pneumatic pivot action of the roller stanchion. To impart a circumferential pattern on a plurality of disc-shaped work pieces, each disc-shaped work piece is placed in a disc position and into contact with a stationary guide roller, a clamping guide roller and the center driving ring until all such disc positions are available for the placement of disc-shaped work pieces are occupied. The center driving ring is then rotated to cause the disc-shaped work pieces to rotate. Since the disc-shaped work pieces are smaller in diameter than the center driving ring, the rotation of the center driving ring will cause the disc-shaped work pieces to rotate at a much faster RPM than that of the center driving ring. Therefore, in a grinding step the center driving ring which may rotate from about 12 to about 180 RPM is rotated at from about 10 to 50 RPM and preferably from about 20 to about 40 RPM for a period of time sufficient to remove the desired amount of material from the disc-shaped work piece. Such a period of time will range from about thirty seconds to about three minutes or more. At the same time, the upper and lower annular platens which can rotate from about 6 to about 90 RPM and which have been brought into contact with the top and bottom dimensions of the disc-shaped work pieces are rotated. The upper and lower annular platens are typically rotated during the grinding step at from about 25 to about 90 RPM and preferably from about 50 to 90 RPM. During this grinding step, lubricants, abrasives and washing fluids may be applied to the disc-shaped work pieces.

The circumferential pattern or "polishing" step begins once the desired amount of material has been removed from the disc-shaped work pieces. During the "polishing" step, the upper and lower annular platens remain in contact with the disc-shaped work pieces. However, the rotation of the center driving ring is increased to a speed from about 75 to about 180 RPM or more and preferably from about 135 to about 180 RPM or more. This rotation range will cause the discs to rotate at from about 800 to about 1200 RPM or more. At the same time, the discs are being rotated at a high rate of speed, the upper and lower annular platen RPM are reduced to about 2 to about 25 RPM or more and preferably from about 5 to about 20 RPM or more during the polishing step. The polishing step imparts the circumferential pattern on the disc-shaped work piece and will be maintained for a period of time ranging from about 30 seconds to about 1 minute or more until the desired pattern is imparted on the top and bottom dimension of the disc-shaped work pieces. Finally the plurality of disc-shaped work pieces are unloaded from the spaces they occupy by pivoting the roller stanchion on the axis away from the disc-shaped work pieces to thereby move the clamping guide rollers laterally away from the discs and then remove the discs from their disc positions.

The preferred speeds indicated for the various rotating pieces of equipment are not meant to limit the scope of the instant invention. It is conceivable that the desired pattern can be imparted on the disc shaped work pieces using very low platen and center ring RPMs. However, such slow speeds would require that the finishing time be increased which would not be efficient. Conversely, the platen and center driving ring RPMs could be greatly increased and the finishing step reduced in time even more. The only limitation in reducing the finishing time will be the availability such high speed motors and control equipment.

Finally, it is not necessary that the upper and lower annular platens be used simultaneously to impart a circumferential pattern on the disc-shaped work pieces. A circumferential pattern may be applied to only the top dimension of the disc-shaped work pieces, the bottom dimension of the disc-shaped work pieces, or to both the top and bottom dimensions of the disc-shaped work pieces. Additionally, the machine can be totally automated such that the loading of the machine, grinding and polishing steps and the unloading of the machine are all performed automatically. In an automatic machine, the disc-shaped work pieces will be located in a loading cassette and placed in the plurality of disc positions simultaneously. The clamping guide rollers will simultaneously be pivoted against the plurality of disc-shaped work pieces and the grinding and polishing steps automatically controlled. The unloading step would also occur simultaneously, that is, the cassette containing the plurality of disc-shaped work pieces would be removed from the upper and lower annular platens simultaneously.

Variations in the structure and formation of the machine of this invention and the method for utilizing the machine of this invention to impart a circumferential pattern on disc-shaped work pieces will become apparent to those skilled in the art. Any such variations as are within the spirit and scope of this invention are intended to be encompassed within the scope of the claims appended hereto, and are protected by any United States patent issued on this invention.

EXAMPLE

By this example, a circumferential pattern was imparted on 20 aluminum alloy discs. Twenty aluminum alloy discs were placed in disc positions in contact with the center driving ring of a finishing machine. Each disc also contacted a stationary guide roller and a clamping guide roller. The center driving ring was rotated at 30 RPM, the upper and lower annular platens were placed into contact with the top and bottom disc dimensions respectively and rotated at 90 RPM for about two minutes to obtain a disc target thickness of about 0.0495". The rotation of the center driving ring was increased to 135 RPM while the rotation of the upper and lower annular platens were reduced to about 6 to 10 RPM. The polishing step lasted about 45 seconds after which the disc-shaped work pieces were removed from the machine.

An analysis of the aluminum alloy discs indicated that they all had top and bottom disc dimensions with surface finishes ranging from 150–200 Ra. The edge on the discs had no curvature and the roll-off sharpness of each of the discs were below 1600 angstroms. Both of these results are well within the specifications set by computer manufacturers.

What is claimed is:

1. A machine for grinding and polishing a plurality of disc-shaped work pieces having a frame work, a polishing assembly, the polishing assembly including an annular lower platen perpendicularly connected to a first spindle, an annular upper platen perpendicularly connected to a second spindle, a center driving ring having an outer edge perpendicularly connected to a third spindle, a plurality of roller stanchions, a stationary guide roller and a clamping guide roller perpendicularly attached to each of the plurality of roller stanchions to define a plurality of stationary guide rollers and a plurality of clamping guide rollers, the center driving ring, a stationary guide roller, and a clamping guiding roller frictionally contacting a disc-shaped work piece between the upper and lower annual platens, at least one motor able to rotate the first, second, and third spindles, the first, second, and third spindles rotating about the same axis.

2. The machine of claim 1 further characterized in that the stationary guide rollers rotate about a first axis, and the clamping guide rollers rotate about a second axis.

3. The machine of claim 2 further characterized in that the roller stanchion is able to pivot on the first axis.

4. The machine of claim 1 further characterized in that the first and second spindles are rotated by a first motor while the third spindle is rotated by a second motor.

5. The machine of claim 1 further characterized in that the first spindle is rotated by a first motor, the second spindle is rotated by a second motor, and the third spindle is rotated by a third motor.

6. The machine of claim 1 further characterized in that the disc-shaped work pieces are contacted with the center driving ring in such a manner that the disc axes of the plurality of disc-shaped work pieces define a first concentric circle having a diameter greater than that of a second concentric circle defined by the outer edge of center driving ring.

7. The machine of claim 6 further characterized in that the clamping guide rollers and the stationary guide rollers contact the disc-shaped work pieces in a pattern defining a third concentric circle having a greater diameter than the first concentric circle.

8. The machine of claim 7 further characterized in that each roller stanchion is located such that the clamping guide roller, and the stationary guide roller perpendicularly attached to the roller stanchion contact adjacent disc-shaped work pieces.

9. A machine for grinding and finishing a plurality of disc-shaped work pieces, the machine having a framework, a polishing assembly, a first motor, and a second motor, the polishing assembly including an annular lower platen perpendicularly connected to a first spindle and an annular upper platen perpendicularly connected to a second spindle, the first and second spindles rotated by the first motor, with a grind stone or polishing pad of both the upper and lower platens centered essentially over the disc axis of each of the plurality of disc-shaped work pieces located in a circular pattern such that the disc axes of the disc-shaped work pieces define a first concentric circle, a center driving ring having an outer edge perpendicularly connected to a third spindle, the third spindle rotated by the second motor, the outer edge of the center driving ring defining a second concentric circle, a plurality of stationary guide rollers, a plurality of clamping guide rollers and a plurality of roller stanchions, a stationary guide roller and a clamping guide roller both perpendicularly connected to each roller stanchion, the stationary guide roller capable of rotating about a first axis, the clamping guide roller capable of rotating about a second axis, and the roller stanchion capable of pivoting on the first axis, each roller stanchion located such that the clamping guide roller and stationary guide roller perpendicularly attached to the roller stanchion contact adjacent disc-shaped work pieces, the stationary guide rollers and clamping guide rollers defining a third concentric circle, the first concentric circle having a greater diameter than the second concentric and the third concentric circle having a greater diameter than the first concentric circle, a combination of the center driving ring, a stationary guide roller, and a clamping roller capable frictionally holding a disc-shaped work piece in a disc position between the upper and lower annular platens.

10. The machine of claim 9 further characterized in that the annular upper platen and annular lower platen both rotate in the same direction.

11. The machine of claim 9 further characterized in that the upper and lower annular platens rotate in opposite directions.

12. The machine of claim 9 further characterized in that the disc-shaped work piece is a metal disc-shaped work piece.

* * * * *